United States Patent [19]

Fast

[11] Patent Number: 4,942,968

[45] Date of Patent: Jul. 24, 1990

[54] SHELF DIVIDER

[76] Inventor: Jacob Fast, 7561 NW. 9th St., Plantation, Fla. 33317

[21] Appl. No.: 326,794

[22] Filed: Mar. 21, 1989

[51] Int. Cl.[5] ..... A47F 5/00

[52] U.S. Cl. ..... 211/184; 108/61; 248/220.4

[58] Field of Search ..... 211/184, 11; 248/248, 248/222.3, 220.4; 108/60, 61

[56] References Cited

U.S. PATENT DOCUMENTS

| | | | |
|---|---|---|---|
| 3,669,278 | 6/1972 | Heroy | 211/184 |
| 3,858,996 | 1/1975 | Jarvis | 248/222.3 |
| 3,954,184 | 5/1976 | Mendenhall | 211/184 |
| 4,181,229 | 1/1980 | Moore | 211/184 |

FOREIGN PATENT DOCUMENTS

| | | | |
|---|---|---|---|
| 2026850 | 2/1980 | United Kingdom | 248/220.4 |

*Primary Examiner*—David L. Talbott

*Attorney, Agent, or Firm*—Fleit, Jacobson, Cohn, Price, Holman & Stern

[57] ABSTRACT

A shelf divider for use on an apertured shelf is made from an elongate strip of plastic sheet divided by a lengthwise fold line in an attachment panel and a divider panel. The attachment panel has a row of fold-down tabs which are inserted into respective apertures of the shelf to secure the attachment panel face-to-face on the shelf. The spacing and orientation of the respective tabs is such as to inhibit accidental or inadvertent removal or displacement of the divider when it is attached.

6 Claims, 2 Drawing Sheets

SHELF DIVIDER

BACKGROUND AND SUMMARY OF THE INVENTION

In supermarkets, warehouses and other product display and storage facilities, it is frequently desirable to divide a display or storage shelf lengthwise or transversely into different product sections. The present invention provides a shelf divider for this purpose which can be readily attached to and removed from a particular type of shelf, namely an apertured shelf, while being resistant to inadvertent removal or displacement.

According to the invention, a shelf divider for the purpose indicated, comprises an elongate strip of flexible material, conveniently plastic sheet divided by a lengthwise fold line into a shelf attachment panel and a fold-up divider panel. The attachment panel has a plurality of press-out tabs for insertion in respective apertures of a shelf to which the divider is to be attached. Each tab has a base along which the tab can be folded, the bases of the respective tabs extending lengthwise substantially along the center line of the attachment panel. The tabs are spaced to conform with the spacing of apertures in a shelf and the tabs face in opposite directions. With this arrangement, when a first one of the tabs has been depressed and inserted through a shelf aperture, it is necessary to twist or rotate the divider lengthwise in order to insert an oppositely directed tab into its respective shelf aperture. A similar twisting or rotating action is required in order to disengage the divider from the shelf apertures, so that the structure effectively inhibits inadvertent removal or displacement of the device. It will be evident that when the divider is attached to a shelf, the attachment panel is face to face with the top of the shelf and the divider is folded up into operative position.

In a preferred form of the invention, the divider has two inner oppositely directed tabs, and two outer oppositely directed tabs. The spacing between each inner tab and the adjacent outer tab preferably is greater than the spacing between the two inner tabs. For example, the spacing between the inner tabs may conform with the spacing between four shelf apertures and the spacing between each inner tab and its adjacent outer tab may conform with the spacing between five shelf apertures. To attach the divider to a shelf, first the inner tabs are inserted in their respective apertures with a degree of rotation of the divider. When both inner tabs have been inserted, the outer tabs are inserted one by one into their respective apertures by twisting or distorting the divider between the respective inner and outer tabs. The increased length of divider between the inner and outer tabs facilitates such twisting or distortion. This form of divider provides a particularly secure, yet releasable attachment.

Additional features and advantages of the invention will be apparent from the ensuing description and claims read in conjunction with the attached drawings.

DESCRIPTION OF THE PREFERRED EMBODIMENT

Figure 1:
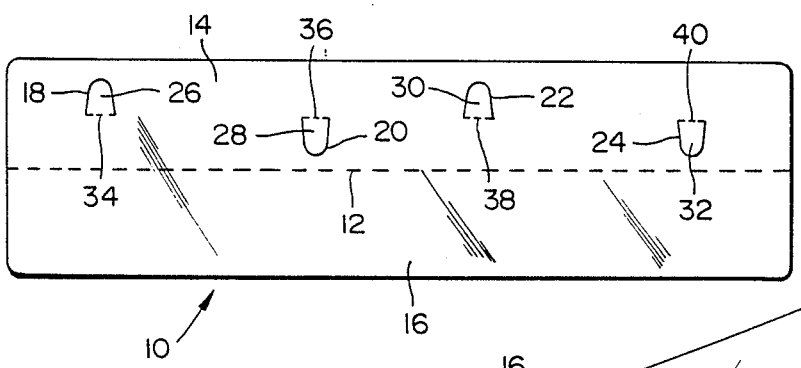
FIG. 1 is a plan view of a shelf divider in accordance with the invention shown before folding into operative condition.
Figure 2:
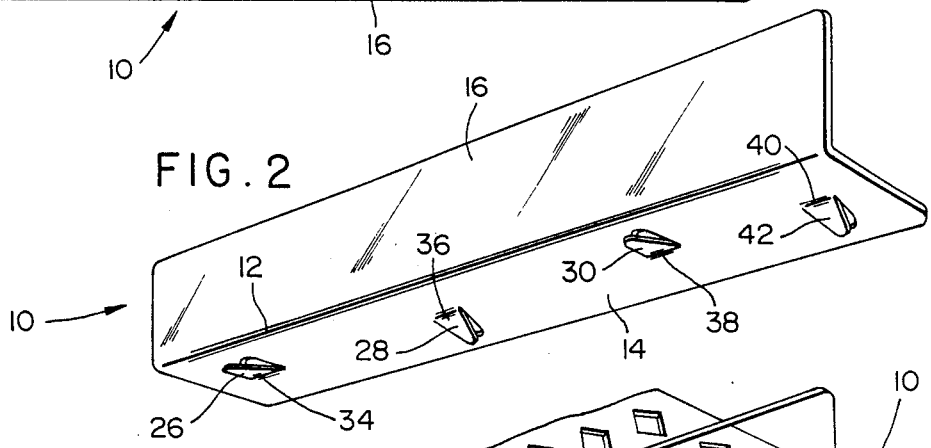
FIG. 2 is a perspective view of the divider folded into operative condition.
Figure 3:
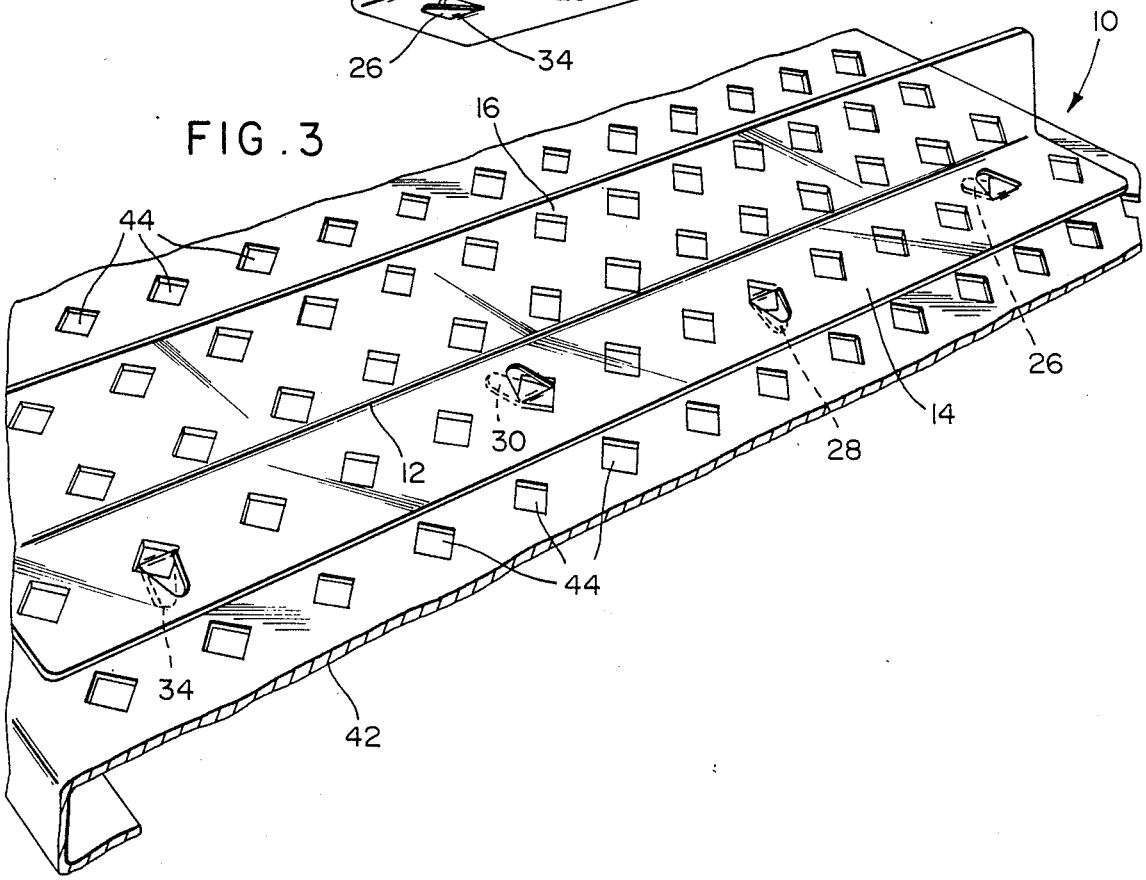
FIG. 3 is a perspective view of the divider attached to a shelf.

A shelf divider in accordance with the invention comprises an elongate strip of plastic sheet 10 divided by a lengthwise fold line 12 into an attachment panel 14 and a divider panel 16. The attachment panel is provided with slits 18, 20, 22, 24 defining four tapered press-down tabs 26, 28, 30, 32 with respective fold-line defined bases 34, 36, 38, 40 about which the tabs can be folded. All of the bases extend lengthwise of the divider substantially along the center line of the panel 14. It will be evident, however, that tabs 26 and 30 extend in opposite directions to tabs 28 and 32 with respect to their bases.

The shelf divider is intended for use on an apertured shelf 42 having shelf apertures 44 and the tabs 26–32 are intended for insertion into respective apertures to hold the divider in place. Thus, the spacing between the tabs conforms to the spacing between groups of shelf apertures. However, the spacing between the inner tabs 28, 30 conforms to the spacing between four of the shelf apertures 44 while the spacing between tabs 26 and 28, and the spacing between tabs 30 and 32 conforms to the spacing between five of the shelf apertures 44.

Figure 4:
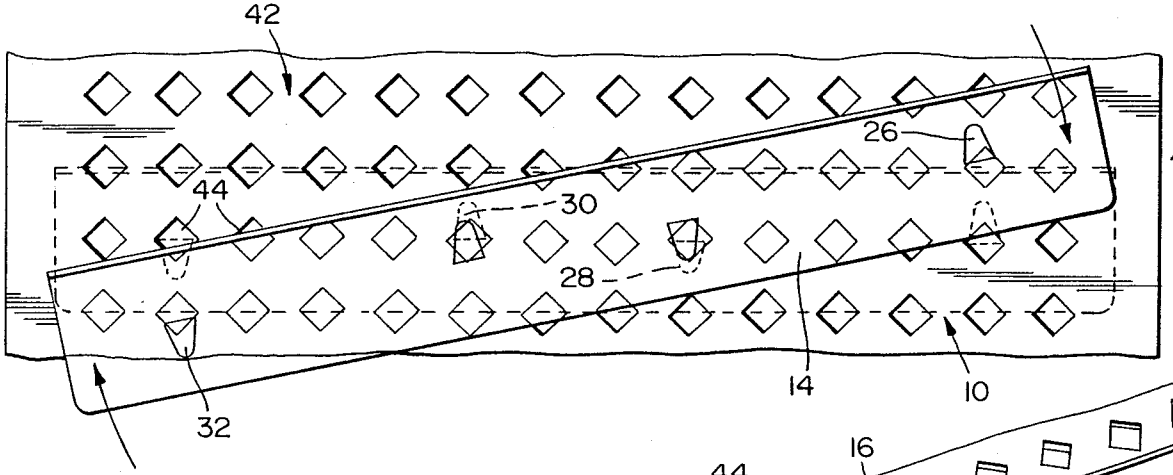
FIG. 4 is a plan view of the shelf and divider showing a first step in attaching the divider.
Figure 5:
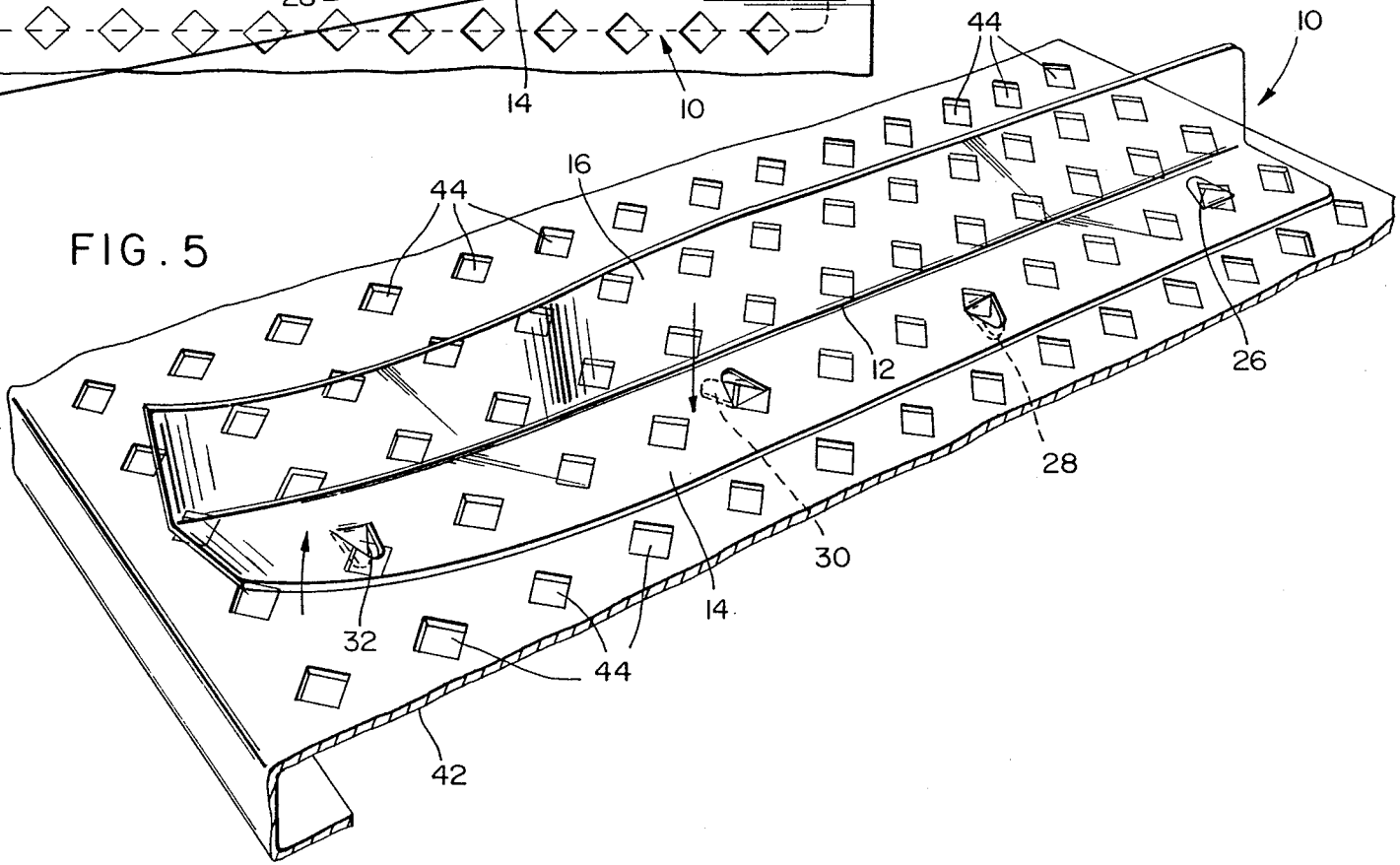
FIG. 5 is a perspective view of the shelf and divider showing a subsequent step in attaching the divider.

The manner of attaching the divider to a shelf is illustrated in FIGS. 4 and 5. Firstly, as shown in FIG. 4, the two inner tabs 28, 30 are depressed and worked into their respective shelf apertures 44 by rotating the divider lengthwise, as shown in full line. When the two inner tabs have been inserted, the divider takes up the position shown in dotted line in FIG. 4. Then, in order to insert each of the outer tabs 26, 32 in the respective shelf aperture, since the central section of the divider is anchored by tabs 28, 30, it is necessary somewhat to twist or distort the respective section end of the divider lengthwise as shown in Figure 5, suitably while grasping the central section of the divider. Such twisting or distortion of the divider is facilitated by the increased length of the divider between each inner tab and the respective outer tab.

It will be understood that in order to remove the divider from the shelf, it is necessary to reverse the above procedure. Since a positive twisting or distortion is required for removal of the divider, it will also be evident that accidental or inadvertent removal or displacement of the divider is effectively inhibited.

While only a preferred embodiment of the invention has been described herein in detail, the invention is not limited thereby, and modifications can be made within the scope of the attached claims. For example, the attachment panel structure can also be used on more rigid L-section extruded and like dividers.

What is claimed is:

1. A shelf divider for use on a shelf having rows of apertures, the divider comprising an elongate strip of material divided lengthwise into a shelf attachment panel and a divider panel, the attachment panel having four tabs spaced lengthwise along the divider panel to form a pair of inner tabs and a pair of outer tabs for insertion into respective apertures of an aperture row of the shelf, each tab having a base along which the tab can be flexed, the bases of the respective tabs being substantially colinear and extending lengthwise of the attachment panel, the tabs being spaced to conform with the spacing of the apertures, and with alternate tabs extending in opposite directions with respect to their bases.

2. The invention as defined in claim 1 wherein the spacing between the pair of inner tabs is less than the spacing between an inner tab and an adjacent outer tab.

3. The invention as defined in claim 1 wherein, the divider comprises a lengthwise fold line defining the respective panels.

4. The invention as defined in claim 1 wherein the tabs are defined by portions which are cutout from the attachment panel.

5. In combination with a shelf having rows of apertures, a shelf divider comprising an elongate strip of material divided lengthwise into an attachment panel secured face-to-face with an upper surface of the shelf and a stand-up divider panel, the attachment panel including four depending tabs spaced lengthwise therealong to form a pair of inner tabs and a pair of outer tabs, the tabs having substantially colinear bases, and with alternate tabs extending in opposite directions from their respective bases, the tabs being inserted in respective apertures of a row to secure the divider to the shelf.

6. The invention as defined in claim 5 wherein the spacing between the inner tabs is less than the spacing between each inner tab and an adjacent outer tab.

* * * * *